United States Patent [19]

Toombs

[11] Patent Number: 4,922,640

[45] Date of Patent: May 8, 1990

[54] BREECH BOLT

[76] Inventor: Chauncey E. Toombs, 8010 Lakeshore Rd., Angola, N.Y. 14006

[21] Appl. No.: 267,288

[22] Filed: Nov. 4, 1988

[51] Int. Cl.[5] ..... F41B 11/06

[52] U.S. Cl. ..... 42/16

[58] Field of Search ..... 42/16; 89/173, 187.02; 124/71

[56] References Cited

U.S. PATENT DOCUMENTS 3,566,745 3/1971 Jauch et al. .
3,636,648 1/1972 Spencer .
3,738,219 6/1973 Febres .
3,848,510 11/1974 Wolpert .

OTHER PUBLICATIONS

Parts Order Sheet for Pursuit Paint Gun Model PG $CO_2$ Pistol, Sheridan Products.

*Primary Examiner*—Charles T. Jordan
*Assistant Examiner*—Richard W. Wendtland
*Attorney, Agent, or Firm*—Bean, Kauffman & Spencer

[57] ABSTRACT

A brech bolt for use in a gas powered gun features a plunger operated ball detent for releasably retaining the bolt in a breech closed position. A method is disclosed for assembling the ball detent.

8 Claims, 1 Drawing Sheet

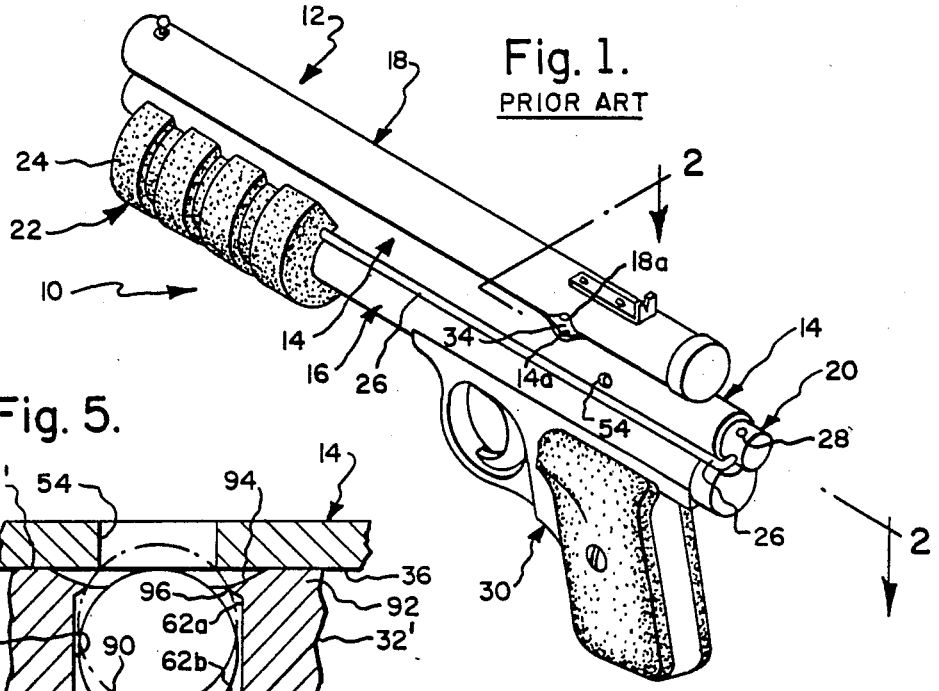
Fig. 1.
PRIOR ART
Fig. 5.
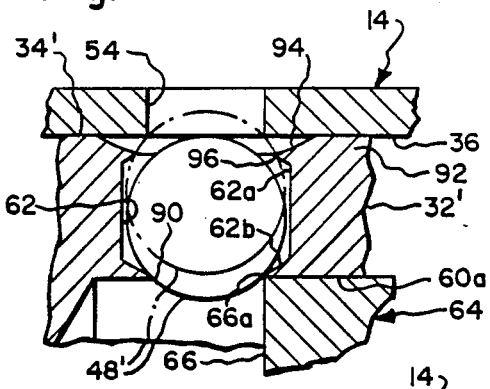
Fig. 2.
PRIOR ART
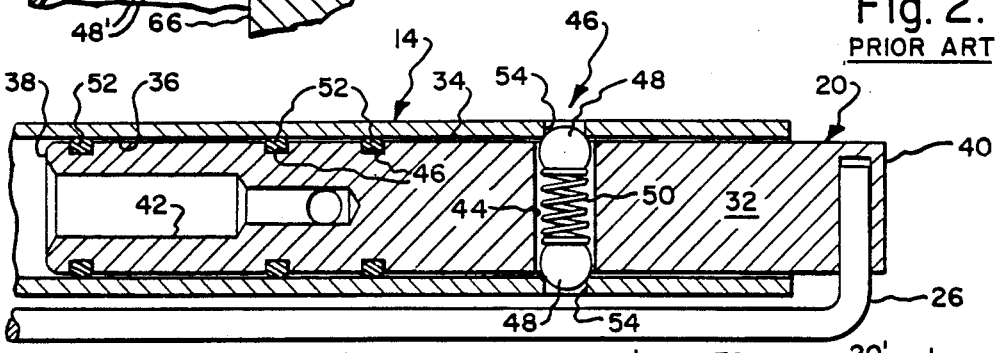
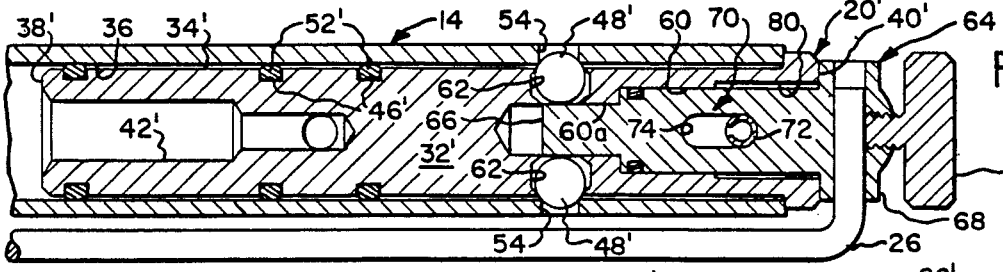
Fig. 3.
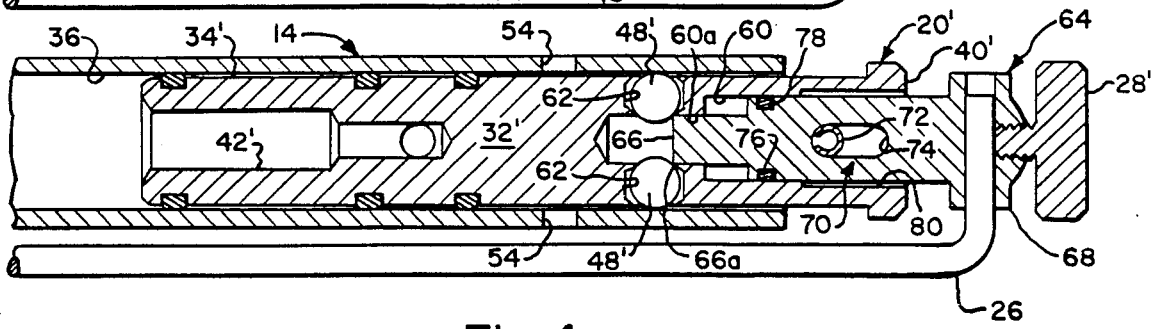
Fig. 4.

BREECH BOLT

BACKGROUND OF THE INVENTION

The game of Splatball employs gas powered guns for propelling marking pellets containing paint, which serves to provide visual evidence that a target has been hit by a fired pellet.

Typically, a Splatball gun employs a spring biased ball detent for releasably retaining its breech bolt in a breech closed position within its gun barrel or propulsion tube, during firing of the gun. The detent spring must be sufficiently strong to exert a spring force to resist movement of the breech bolt from its breech closed position under the influence of a pressurized gas, such as may be supplied by a $CO_2$ cartridge, which is momentarily introduced into the breech of the gun for purposes of firing a marking pellet. In that this spring force must be manually overcome before the breech bolt can be moved into its breech open or marking pellet loading position, many players of Splatball find it physically difficult to load many presently available guns and/or find this operation to become exceedingly tiring over the period of a game.

Oftentimes, during a Splatball game, a marking pellet will break within a gun barrel, and this requires prompt field stripping or complete removal of a breech bolt from within the barrel in order to gain complete access to the barrel, as well as the breech bolt, for cleaning purposes. The construction of the spring biased ball detents presently employed in the typical Splatball guns is such that the ball detents, which are carried by the breech bolt, are constrained against radially outwardly directed movement under the bias of their associated detent spring only by engagement with the inner surface of the gun barrel. Thus, when the breech bolt is removed for cleaning purposes, the ball detents and oftentimes their spring detent separate from the breech bolt and may become lost. Further, the force required to reposition the ball detents within the breech bolt against the bias of the detent spring makes it difficult to reassemble the breech bolt within the gun barrel after cleaning thereof has been accomplished.

SUMMARY OF THE INVENTION

The present invention is directed towards an improved breech bolt for gas operated guns, and more particularly to an improved ball detent mounting and operating assembly, which ensures positive locking of a breech bolt in a breech closed position, while permitting the exercise of minimal manual force to move the breech bolt into a breech open position when desired to load a gun with a marking pellet.

The breech bolt of the present invention preferably includes a generally cylindrical body having an outer surface, a first end for closing a breech, a second end, a first opening extending axially within the body through the second end, at least one detent opening extending generally radially through the body between its outer surface and first opening, an operating plunger slidably supported within the first opening and having an operating end disposed within the body and a mounting end disposed outwardly of the body for attachment with an operator of the breech bolt, motion limiting means for limiting movement of the plunger between operative and inoperative positions, and a ball detent mounted in each detent opening for movement between extended latching and retracted release positions. The operating end of the plunger is arranged to engage with the ball detent to move same into its locking position to effect locking of the breech bolt within the gun barrel in breech closed position upon movement of the plunger into its operative position, and to permit movement of such ball detent into its release position to effect release of the breech bolt for movement into breech open position, upon movement of the plunger into its inoperative position.

A method is disclosed for mounting the ball detents within their detent openings so as to provide a breech bolt/detent assembly from which ball detents cannot be lost when the breech bolt is removed from the gun barrel for cleaning purposes.

BRIEF DESCRIPTION OF THE DRAWINGS

The nature and mode of operation of the present invention will now be more fully described in the following detailed description taken with the accompanying drawings wherein:

FIG. 1 is a perspective view of a gas powered gun with which the breech bolt of the present invention possesses utility;

FIG. 2 is a sectional view taken generally along the line 2—2 in FIG. 1 and showing a prior breech bolt construction;

FIG. 3 is a sectional view similar to FIG. 2, but showing the breech bolt of the present invention in breech closed position;

FIG. 4 is a sectional view similar to FIG. 3, but showing the breech bolt in breech open position; and FIG. 5 is an enlarged view of the ball detent employed in the present invention.

DETAILED DESCRIPTION

A prior gas powered air gun of the type used in the game of "Splatball" is designated as 10 in FIG. 1 and shown for purposes of reference in FIGS. 1 and 2 as generally including a tube assembly 12 having a barrel 14, a filler tube 16 for receiving a source of compressed gas in the form of a $CO_2$ cartridge, not shown, and a magazine tube 18 for storing a supply of marking or paint pellets, not shown; a breech bolt 20; a breech bolt operating assembly 22 having a manually operated member 24 slidably supported by the filler tube and removably attached to the breech bolt by a connecting rod 26 and threaded locking device 28; and a hand grip and trigger assembly 30. Magazine tube 18 and barrel 14 have vertically aligned discharge and breech openings **18*a* and 14*a***, respectively, permitting passage of marking pellets one at a time from the magazine tube into the barrel.

Prior breech bolt 20 is best shown in FIG. 2 as having a generally cylindrical body 32 formed with an outer surface 34 sized for slidable receipt within the bore 36 of barrel 14, a first breech closing end 38, a second end 40 for attachment to connecting rod 26, a flow passage 42 opening through the breech closing end to permit introduction of compressed gas to the breech from filler tube 16, a transversely extending bore opening 44 and a plurality of annular grooves 46; a ball detent device 46 defined by a pair of ball detents 48,48 and a compression type detent spring 50 received within the bore opening; and O-ring type seals 52 received within the annular grooves for slidably sealing against the bore of the barrel. Ball detents 48,48 are biased radially outwardly of body 32 by detent spring 50 into an operative position in which they are removably received within ball detent receiving apertures or latch openings 54,54 formed in barrel 14 for purposes of defining a breech closed position of breech bolt 20 shown in FIGS. 1 and 2, wherein the breech bolt closes breech opening 14*a* and flow passage 42 is disposed for flow communication with pressurized gas from filler tube 16 when gun 10 is fired.

Breech bolt 20 may be moved to the right, as viewed in FIG. 2, into a breech open position, not shown, under the control of operating assembly 22 when desired to uncover breech opening 14*a* and permit the gravity feeding of a marking pellet therethrough into barrel 14; return movement of the breech bolt under the control of the operating assembly into its illustrated position serving to move the marking pellet forwardly within barrel 14 and seal off the breech opening in preparation for subsequent firing of gun 10. A major disadvantage of the type of gun depicted in FIGS. 1 and 2 is the amount of force required to be exerted on operating assembly 22 for purposes of effecting compression of detent spring 50 as required to permit ball detents 48,48 to ride out of barrel apertures 54,54 into retracted positions within bore opening 44 as required to allow breech bolt 20 to be moved away from its illustrated breech closing position.

Breech bolt 20 may be moved to the right, as viewed in FIG. 2, past its breech open position to allow removal of the breech bolt from barrel 14 for barrel/-breech bolt cleaning purposes, upon loosening of threaded locking device 28 to permit removal of connecting rod 26 from the lock bolt and removal of a bolt locking lug, not shown. A second major disadvantage with a gun of the type depicted in FIGS. 1 and 2, is that the bias of detent spring 50 serves to force ball detents 48,48 from within bore opening 44 upon removal of lock bolt 20 from within barrel 14. The resultant loose ball detents 48,48 are easily lost and in any event are difficult to reinsert into bore opening 44 against the bias of detent spring 50 when it is desired to reinsert breech bolt 20 into barrel 14.

A gun of the type generally described above is available commercially from Sheridan Products of Racine, Wis. under the designation Model PG $CO_2$ Pistol or Model PGP $CO_2$ Paint Pistol.

A breech bolt formed in accordance with the present invention is adapted to replace breech bolt 20 originally forming a part of gun 10 in order to overcome the above discussed disadvantages of such gun. To facilitate understanding of the present invention shown in FIGS. 3–5, like primed numerals are employed to designate the present breech bolt and parts thereof which are essentially identical to those of breech bolt 20.

Present breech bolt 20' differs from breech bolt 20 in that its body 32' is formed with a first, stepped diameter opening 60 arranged to extend axially therewithin through second end 40' and preferably two detent openings 62,62 for supporting ball detents 48',48' and arranged to extend radially between outer surface 34' and the first opening adjacent a forward or inner end thereof. Breech bolt 20' additionally includes a stepped diameter operating plunger 64 slidably supported within first opening 60 and having an operating end 66 disposed within body 32' for operative engagement with ball detents 48',48' and a mounting end 68 disposed outwardly of the body for removable attachment to assembly 22, as by a clamping means 28' of known construction; and a motion limiting device 70 for limiting movement of the operating end of the plunger relative to body 32' between operative and inoperative positions shown in FIGS. 3 and 4, respectively.

Motion limiting device 70 preferably includes a roll pin 72 non-removably fixed to body 32' to extend transversely within first opening 60 and a motion limiting slot 74 formed in plunger 64 and sized to slidably receive the roll pin.

Plunger 64 is preferably provided with an annular groove 76 for receiving an O-ring 78, which serves to provide a slight frictional resistance to the sliding movement of the plunger within first opening 60. When O-ring 78 is employed, it is desirable to slightly increase the diameter of the outer end of first opening 60, as indicated at 80, to a point slightly inwardly beyond openings, not shown, provided in body 32' for supporting the ends of roll pin 72. Otherwise, the edges of such openings would tend to cut pieces of material from O-ring 78 incident to initial insertion of plunger 64 into first opening 60, which might interfere with the proper operation of breech bolt 20'.

In accordance with a preferred embodiment of the present ivention, ball detents 48',48' are permanently carried by or assembled within detent openings 62,62 in body 32' by a unique procedure involving forming each of the detent openings, as by a drilling operation, to define an open end or first portion 62*a* opening or extending through outer surface 34' and an opposite end or second portion 62*b* opening or extending through an inner surface 60*a* defined by first opening 60. Each first end 62*a* is formed with a diameter sufficient to permit its associated ball detent 48' to freely move lengthwise thereof, and each opposite end 62*b* defines a constriction 90 formed with a diameter, which prevents passage of its associated ball detent outwardly of detent opening 62, while permitting such ball detent to partially project into first opening 60 when engaged with such opposite end, as best shown in FIGS. 4 and 5. When detent openings 62,62 are formed by single drilling operations, opposite ends 62*b*,62*b* are of generally conical configuration due to the tapered end of the drill with which the detent openings are formed.

After the initial opening forming operation, the wall 92 of body 32' bounded by outer surface 34' and surface 60*a* of first opening 60 is deformed adjacent the outer surface, as by performing a stamping or dimpling operation, to create an outwardly facing dimple 94 and an adjacent constriction 96 arranged to project transversely of first end 62*a*. As formed constriction 96 has a size/configuration sufficient to normally prevent passage of an associated ball detent 48' therepast inwardly and outwardly of first end 62*a* through outer surface 34', while allowing the ball detent, when positioned within first end 62*a*, to partially project outwardly of outer surface 34' when engaged with the constriction.

After completion of the deforming operation, each ball detent 48' is forced or driven into its detent opening 62 past its associated constriction 96 to position the ball detent within first end 62*a* intermediate constrictions 90 and 96. It will be understood that body 32' is formed of metal or other material possessing the property of being resiliently deformable and that the size/configuration of constriction 96 is such as to allow the constriction to resiliently deform sufficiently to allow inward passage of ball detent 48' and then resiliently return to or essentially to its initial or as-formed condition for purposes of thereafter retaining the ball detent within its detent opening.

Constrictions 90 and 96 are spaced and arranged and ball detent 48' is sized to allow the ball detent to assume an operative position, wherein it projects partially beyond outer surface 34' when the ball detent is disposed essentially flush with inner surface 60*a*, and to assume a retracted position, wherein it projects partially beyond the inner surface when disposed essentially flush with the outer surface, as shown in broken and solid line, respectively in FIG. 5. Preferably, the arrangement is such that a slight spacing exists between ball detents 48',48' and constrictions 96,96 when the ball detents are forced to assume their operative positions, as by engagement of the ball detents with operating end 66 when the plunger 64 is in its operative position, in order to avoid any possibility of stressing these constrictions and/or wedging of the ball detents thereinto after the assembly operation has been completed.

The mode of operation of gun 10 when fitted with breech bolt 20' of the present invention will now be described by first making reference to FIG. 3 wherein the breech bolt is shown as being in its breech closed position. In this position of breech bolt 20', second end 40' of body 32' is preferably disposed in abutting engagement with the rear end of barrel 14 to position detent openings 62,62 in radial alignment with barrel apertures 54,54; and plunger 64 is disposed in its operative position defined by engagement of roll pin 72 with the outer end of slot 74 and/or, if desired, by abutting engagement of plunger mounting end 68 with body second end 40', to position plunger operating end 66 in operative engagement with ball detents 48',48' with the result that the latter are forced outwardly into barrel apertures 54,54 for breech bolt locking purposes. Frictional engagement of O-ring 78 with the wall of first opening 60, as well as the frictional characteristics of operating assembly 22, serves to prevent unintended movement of plunger 64 from its operative position, and thus breech bolt 20' from its breech closed position.

When it is desired to move breech bolt 20' into its breech open position to allow for insertion of a marking pellet into barrel 14 through breech opening 14*a*, assembly 22 is manually manipulated to effect movement of the breech bolt to the right as viewed in FIG. 3. As an incident to this movement, plunger 64, due to its direct attachment to connecting rod 26, is first moved or displaced relative to both body 32' and barrel 14, which remain locked together in the initial position of the body depicted in FIG. 3 by receipt of ball detents 48',48' within barrel apertures 54,54, until the plunger has been displaced sufficiently to disengage plunger operating end 66 from the ball detents. Coincident therewith, but preferably shortly thereafter, the inner end of slot 74 is brought into engagement with roll pin 72, whereby to connect body 32' to plunger 64 for movement therewith under the control of assembly 22 until breech bolt 20' arrives in a suitably defined breech open position.

When it is desired to return breech bolt 20' to its breech closed position shown in FIG. 3, assembly 22 is manually operated to effect return movement of the breech bolt to the left, as viewed in FIG. 4. In that only plunger 64 is directly connected to assembly 22, movement of the assembly is directly transmitted to the plunger and the plunger in turn serves to push body 32' for return to its initial breech closed position. Pushing of body 32' is effected with the aid of O-ring 78, but primarily by engagement of a relatively sharp rim 66*a* of plunger operating end portion 66 with ball detents 48',48', which are constrained against radially outwardly directed displacement from their position shown in FIG. 4 and in solid line in FIG. 5 by rolling and/or sliding engagement with the inner surface 36 of barrel 14. Preferably, rim 66*a* is arranged to engage with ball detents 48',48' in the manner or angular relationship shown in FIG. 5, such that the axially directed force vector exerted on the ball detents by rim 66*a*, that is, the body pushing force vector, is equal to or exceeds the radially directed force vector in order to prevent the generation of radially directed forces on the ball detents, which would be sufficient to effect deformation of barrel 14 and/or create sufficient friction to retard sliding movement of body 32' forwardly within the barrel. As body 32' reaches its initial position shown in FIG. 3, detent openings 62,62 are returned for alignment with barrel apertures 54,54 to free ball detents 48',48' to move outwardly thereinto incident to final movement of plunger 64 relative to the body from the position shown in FIG. 5 to that shown in FIG. 3.

As in the case of breech bolt 20, breech bolt 20' may be removed from within the confines of barrel 14 for cleaning purposes by disconnecting plunger 64 from connecting rod 26 and body 32' from tube assembly 12 by removal of the previously mentioned bolt locking lug, not shown. When breech bolt 20' is removed, ball detents 48',48' are retained within detent openings 62,62 by constrictions 90 and 96.

The described method of mounting ball detents within detent openings possesses general utility, and it is anticipated that ball detents so mounted are not limited for use in an environment in which same are required to be operated by a plunger operator, which is relatively movable relative to the body or member in which the detent openings are formed. As by way of example, the method has utility for permanently mounting ball detents in blind bores or openings into which a compression type detent operating spring is fitted prior to insertion of the ball detents.

What is claimed is:

1. An improved breech bolt for use in a gas powered gun of the type having a barrel for slidably receiving said breech bolt, said barrel having at least one radially extending latch opening, and an operator for moving said breech bolt within said barrel between breech closed and open positions, said breech bolt comprising:

a generally cylindrical body having an outer surface, a first breech closing end, a second end, a first opening extending axially within said body through said second end and at least one detent opening extending radially of said body between said first opening and said outer surface and having a reduced diameter at said first opening;

an operating plunger slidably supported within said first opening and having an operating end disposed within said body and a mounting end disposed outwardly of said body for attachment to said operator;

motion limiting means for limiting movement of said operating end within said first opening between operative and inoperative positions; and a ball detent movably supported within said detent opening, said operating end engaging with said ball detent when said plunger is disposed in said operative position to position said ball detent is an operative position thereof in which said ball detent partially projects outwardly of said outer surface for receipt within said latch opening, and said operating end being removed from engagement with said ball detent when said plunger is disposed in said inoperative position for permitting movement of said ball detent inwardly of said detent opening into a retracted position thereof in which said ball detent is removed from within said latch opening.

2. A breech bolt according to claim 1, wherein said detent opening has radially outer and inner ends and a diameter intermediate said outer and inner ends exceeding the diameter of said ball detent sufficient to permit free sliding movement of said ball detent lengthwise thereof, said radially outer and inner ends having constrictions limiting movement of said ball detent lengthwise within said detent opening between said operative and retracted positions.

3. A breech bolt according to claim 1, wherein said detent opening is defined by a drilled opening in said body having an outer portion extending inwardly through said outer surface and being of a diameter sufficient to permit free sliding movement of said ball detent lengthwise thereof and an inner portion of reduced diameter permitting passage of said ball detent only partially into said first opening for engagement with said operating end of said plunger, an outer end of said outer portion having a constriction projecting thereinto sufficiently to capture said ball detent within said drilled opening, while permitting said ball detent to partially project outwardly beyond said outer surface, said constriction being formed by permanently deforming said body and being characterized as having sufficient resiliency to permit temporary deformation thereof to allow passage of said ball detent therepast into said drilled opening intermediate said constriction and said inner portion.

4. A breech bolt according to claim 3, wherein said plunger carries an O-ring engaging with said body within said first opening to frictionally resist relative sliding movements of said plunger within said body.

5. A breech bolt according to claim 3, wherein said operating end of said plunger has a sharp annular rim arranged to engage with said ball detent incident to movement of said plunger relative to said body between said inoperative and operative positions to effect movement of said ball detent between said retracted and operative positions thereof, characterized in that said rim and said ball detent when retained in said retracted position are arranged such that when said plunger is moved from said inoperative position thereof towards said operative position thereof, said rim applies axial and radial forces to said ball detent extending axially and radially of said body, said axial force being essentially equal to or exceeding said radial force.

6. A breech bolt according to claim 5, wherein said plunger carries an O-ring engaging with said body within said first opening to frictionally resist relative sliding movements of said plunger within said body.

7. A breech bolt according to claim 1, wherein said operating end of said plunger has a sharp annular rim arranged to engage with said ball detent incident to movement of said plunger relative to said body between said inoperative and operative positions to effect movement of said ball detent between said retracted and operative positions thereof, characterized in that said rim and said ball detent when retained in said retracted position are arranged such that when said plunger is moved from said inoperative position thereof towards said operative position thereof, said rim applies axial and radial forces to said ball detent extending axially and radially of said body, said axial force being essentially equal to or exceeding said radial force.

8. A breech bolt according to claim 7, wherein said plunger carries an O-ring engaging with said body within said first opening to frictionally resists relative sliding movements of said plunger within said body.

* * * * *